US008723418B2

(12) United States Patent
Kano et al.

(10) Patent No.: US 8,723,418 B2
(45) **Date of Patent: *May 13, 2014**

(54) LIGHT SOURCE DEVICE WITH STARTING AID

(75) Inventors: Yosuke Kano, Saitama (JP); Nobuo Fukuda, Saitama (JP); Makoto Ohkahara, Saitama (JP); Yousuke Ishikawa, Saitama (JP); Sumio Uehara, Saitama (JP)

(73) Assignee: Iwasaki Electric Co., Ltd., Tokyo (JP)

( * ) Notice: Subject to any disclaimer, the term of this patent is extended or adjusted under 35 U.S.C. 154(b) by 79 days.

This patent is subject to a terminal disclaimer.

(21) Appl. No.: 13/319,736

(22) PCT Filed: Apr. 27, 2010

(86) PCT No.: PCT/JP2010/057462

§ 371 (c)(1),
(2), (4) Date: Dec. 19, 2011

(87) PCT Pub. No.: WO2010/131574

PCT Pub. Date: Nov. 18, 2010

(65) Prior Publication Data

US 2012/0091875 A1 Apr. 19, 2012

(30) Foreign Application Priority Data

May 14, 2009 (JP) ..... 2009-117108
May 29, 2009 (JP) ..... 2009-130211
Jun. 30, 2009 (JP) ..... 2009-154611

(51) Int. Cl.
*H01J 61/54* (2006.01)
*H01J 61/92* (2006.01)
*H01J 61/86* (2006.01)

(52) U.S. Cl.
USPC ..... 313/594; 313/3; 313/609; 313/623

(58) Field of Classification Search
USPC ..... 313/609, 594, 623, 3
See application file for complete search history.

(56) References Cited

U.S. PATENT DOCUMENTS 5,990,599 A * 11/1999 Jackson et al. ..... 313/25

(Continued)

FOREIGN PATENT DOCUMENTS

JP 2000-58002 2/2000
JP 2001-512622 8/2001

(Continued)

OTHER PUBLICATIONS

JP2008-140614.*

*Primary Examiner* — Nimeshkumar Patel
*Assistant Examiner* — Jacob R Stern
(74) *Attorney, Agent, or Firm* — Greenblum & Bernstein P.L.C.

(57) ABSTRACT

A starting light source for radiating the UV-light to a discharge chamber upon starting lighting of a high pressure discharge lamp includes a discharge tube for generating the UV-light by a starting voltage applied upon starting lighting the lamp, the discharge tube includes an internal electrode extended from a pinch seal portion formed at one end to a light-emitting portion thereof and an external electrode disposed close to or in contact with both of the light-emitting portion and the pinch seal portion, at least a portion of the external electrode disposed for the light-emitting portion includes a holder formed by bending fabrication of a metal sheet into such a shape of gripping and holding the discharge tube, and a terminal is formed to the holder for fixing and electrically connecting the external electrode to a conductor part having a polarity opposite to that of the internal electrode.

8 Claims, 10 Drawing Sheets

(56) References Cited

U.S. PATENT DOCUMENTS

| | | | | |
|---|---|---|---|---|
| 6,215,254 | B1 | 4/2001 | Honda et al. | |
| 2009/0224667 | A1 * | 9/2009 | Fujii et al. | 313/567 |
| 2011/0204765 | A1 | 8/2011 | Kano et al. | |
| 2012/0025688 | A1 | 2/2012 | Ohkahara et al. | |

FOREIGN PATENT DOCUMENTS

| | | |
|---|---|---|
| JP | 2006-120599 | 5/2006 |
| JP | 3137961 | 11/2007 |
| JP | 2008-140614 | 6/2008 |
| JP | 2009-212041 | 9/2009 |

* cited by examiner

LIGHT SOURCE DEVICE WITH STARTING AID

TECHNICAL FIELD

The present invention concerns a light source device used, for example, in liquid crystal projectors, DLP projectors, illumination device, etc.

BACKGROUND ART

In light source devices for liquid crystal projectors and DLP projectors which are required to be reduced in size and provide bright projection images, short arc type high pressure mercury vapor discharge lamps which are small in size and can provide light emission at high brightness have been used as the light source. Since the lamps of this type involve a problem that starting performance under cold condition and restarting performance are not generally preferred under hot restrike condition, start assisting light sources are provided to enhance the starting performance.

A light source device shown in FIG. 13 has a discharge tube 80 that radiates a UV-light to a discharge chamber 54 of a high pressure discharge lamp 51 upon starting lighting is disposed (refer to Patent Document 1).

The high pressure discharge lamp 51 has a discharge chamber 54 disposed in a central portion of an arc tube 52 comprising a quartz glass tube where a pair of tungsten electrodes 56, 56 are opposed to each other at a short inter-electrode distance of about 1 mm, a starting gas such as mercury and a halogen, for example, bromine and an argon gas is filled, and a pair of electrode sealed portions 59R, 59L encapsulating an electrode 56, a metal foil 57, and an electrode lead 58 from the discharge chamber 54 to both ends of the arc tube 52 and is connected to a lighting circuit by way of electrode leads 58, 58 protruding from end faces of the electrode sealed portions 59R, 59L.

Then, the high pressure discharge lamp 51 is integrally attached to a concave reflector 81 by inserting an electrode sealed portion 59L on one side through a bottom hole 83 formed in the bottom of the concave reflector 81, and a glow discharge tube 80 is disposed as an auxiliary, a start of the light source for radiating the UV-light enhancing the starting performance of the lamp 51 upon starting of lighting to the discharge chamber 54.

Further, since the glow discharge lamp 80 has a simple structure of sealing since a rare gas such as an argon gas containing mercury vapor inside a glass seal tube 84 comprising quartz glass, an internal electrode 85 comprising a metal foil having a pair of lead wires 86, 86 protruding from both ends of the glass seal tube 84, and forming a coiled external electrode 87 by winding a chromium-aluminum iron alloy wire 89 of about 0.2 mm diameter around the outer periphery of the glass seal tube 84, it has an advantage that the manufacturing cost is not increased.

The internal electrode 85 and the external electrode 87 of the glow discharge tube 80 are connected respectively to one polar side 88R and the other polar side 88L of the lamp lighting circuit and, when a starting high frequency pulse voltage is applied between the internal electrode 85 and the external electrode 87, glow discharge occurs in the mercury vapor sealed in the glass seal tube 84 as the main body of the discharge tube 80 to generate the UV-light, and a portion of the UV-light is radiated directly through a vent hole 82 for cooling air formed in the reflector 81 to the discharge chamber 54 of the lamp 51 disposed inside the reflector 81, or radiated by reflection on the reflection surface of the reflector 81.

However, in a case of forming the coiled external electrode 87 is disposed at the outer periphery of the glass seal tube, when the number of turns of coils is small, since the generation amount of the UV-light from the discharge tube 80 is small, no necessary and sufficient amount of the UV-light can be radiated to the discharge chamber 54 of the lamp 51. Further, when the number of turns of the coiled external electrode 87 is increased, the UV-light is shielded by the external electrode 87 and a necessary and sufficient amount of the UV-light cannot be radiated to the discharge chamber 54 of the lamp 51.

Further, the discharge tube 80 is held at a predetermined position by connecting the lead 86 of the internal electrode 85 of the discharge tube 80, and the coiled external electrode 87 to one polar side 88R and the other polar side 88L of the lamp lighting circuit. When both electric connection and mechanical holding for the discharge tube 80 are intended by the connection of the lead and the coils, this results in a problem that positioning for the discharge tube 80 is difficult and in a case of providing fixing means additionally, the structure is complicated.

PRIOR ART DOCUMENT

Patent Document

[Patent document 1] Utility Model Registration No. 3137961

SUMMARY OF THE INVENTION

Subject to be Solved by the Invention

A technical subject of the present invention is to attain easy and reliable attachment and positioning of a starting light source and improve the starting performance by efficiently radiating a necessary and a sufficient amount of a UV-light in a discharge chamber of a high pressure discharge lamp.

Means for Solving the Subject

For solving the subject described above the present invention provides a light source device including:

a high pressure discharge lamp having a pair of electrodes opposed each other and at least a light-emitting material and a starting gas filled in a discharge chamber of an arc tube, and a pair of electrode sealed portions for encapsulating each of the electrodes by airtightly sealing a portion from the discharge chamber to both ends of the arc tube, and connected by way of electrode leads protruding from end faces of respective electrode sealed portions to a lighting circuit, and a starting light source that radiates a UV-light to the discharge chamber for enhancing the starting performance of the lamp upon starting lighting, wherein the starting light source comprises a discharge tube that generates the UV-light by application of a starting voltage between the electrodes upon starting lighting of the lamp, the discharge tube comprises:

an internal electrode extending from a pinch seal portion formed on one end thereof to a light-emitting portion and an external electrode close to or in contact with both of the light-emitting portion and the pinch seal portion, in which at least a portion of the external electrode formed at a portion disposed for the light-emitting portion comprises a holder formed by bending fabrication of a metal sheet into a shape of gripping and holding a discharge tube, and the holder has a terminal for electric connection fixed to a conductive part applied with a voltage at a polarity opposite to that of the internal electrode.

Effect of the Invention

According to the invention, since at least the portion the light-emitting portion of the external electrode of the discharge tube as a starting light source of the high pressure discharge lamp comprises a holder formed by bending fabrication of a metal sheet into a shape of gripping and holding the outer periphery of the discharge tube while exposing a portion thereof, the external electrode can be provided to the discharge tube by merely attaching the discharge tube to the holder.

In the holder, since a terminal for fixing the external electrode to the conductive part applied with a voltage at a polarity opposite to that of the internal electrode, when a tongue-like press fit terminal or the like is formed, this can be easily fixed to the electrode lead or the like by bending the tongue, the discharge tube can be positioned easily and the operation of wiring the external electrodes can also be simplified.

Then, upon starting lighting of the high pressure discharge lamp, when a starting voltage supplied from the starting circuit is applied between the external electrode and the internal electrode, the UV-light is radiated from the discharge tube.

Since the discharge tube is held in a state of exposing the outer periphery by the holder, when the discharge tube is attached with the exposed portion facing the discharge chamber of the high pressure discharge lamp, the UV-light emitted from the discharge tube is radiated through the exposed portion to the discharge chamber of the high pressure discharge lamp.

In this case, since the external electrode is disposed close to or in contact with both of the light-emitting portion and the pinch seal portion of the discharge tube, the area of the external electrode is increased more than that in the case where the electrode is disposed only to the light-emitting portion. Further, since the portion disposed to the light-emitting portion is formed by bending the metal sheet so as to grip the outer periphery of the discharge tube, the area is increased more than that of the coiled external electrode when comparing the portion disposed to the light-emitting portion, and the amount of the UV-light generated from the discharge tube is increased, so that the high pressure discharge lamp can be started for lighting at a voltage lowered by so much and the starting performance of the high pressure discharge lamp is improved.

MODE FOR CARRYING OUT THE INVENTION

A best mode for a light source device according to the present invention includes a high pressure discharge lamp having a pair of tungsten electrodes opposed each other and at least a light-emitting material and a starting gas such as mercury, halogen, for example, bromine and an argon gas filled in a discharge chamber of an arc tube, and a pair of electrode sealed portions for encapsulating each of the electrodes by airtightly shrink sealing a portion from the discharge chamber to both ends of the arc tube comprising quartz glass, and is connected by way of electrode leads comprising a molybdenum wire protruding from end faces of respective electrode sealed portions to a lighting circuit, and a starting light source that radiates a UV-light to the discharge chamber for enhancing the starting performance of the lamp upon starting lighting.

The starting light source includes a discharge tube connected in parallel with a lamp to a lighting circuit that applies a starting voltage between tungsten electrodes upon starting lighting of the lamp and generating a UV-light by application of the starting voltage between the external electrode and the internal electrode.

The internal electrode of the discharge tube is encapsulated at the base end thereof in the pinch seal portion formed on one end of the discharge tube and extended at the top end thereof so as to be exposed from the pinch seal portion to the light-emitting portion.

Further, the external electrode is disposed being close to or in contact with both of the light-emitting portion and the pinch seal portion, and at least a portion thereof disposed to the light-emitting portion comprises a holder formed by bending fabrication of a metal sheet to a shape of gripping and holding the outer periphery of the discharge tube in a state of exposing a portion thereof, and a terminal is formed to the holder for fixing and electrically connecting the external electrode to the conductive part to be applied with a voltage at a polarity opposite to that of the internal electrode.

In the discharge tube, a main body is formed of a glass seal tube made of quartz glass, a rare gas such as an argon gas is sealed inside the glass seal tube, an internal electrode comprising a metal foil such as a molybdenum foil is contained in the seal tube, and a lead wire welded to one end of the internal electrode is protruded from one end of the glass seal tube. The material to be sealed in the discharge tube is not restricted only to the rare gas but may also be a rare gas containing mercury vapor.

Embodiment 1

Figure 1:
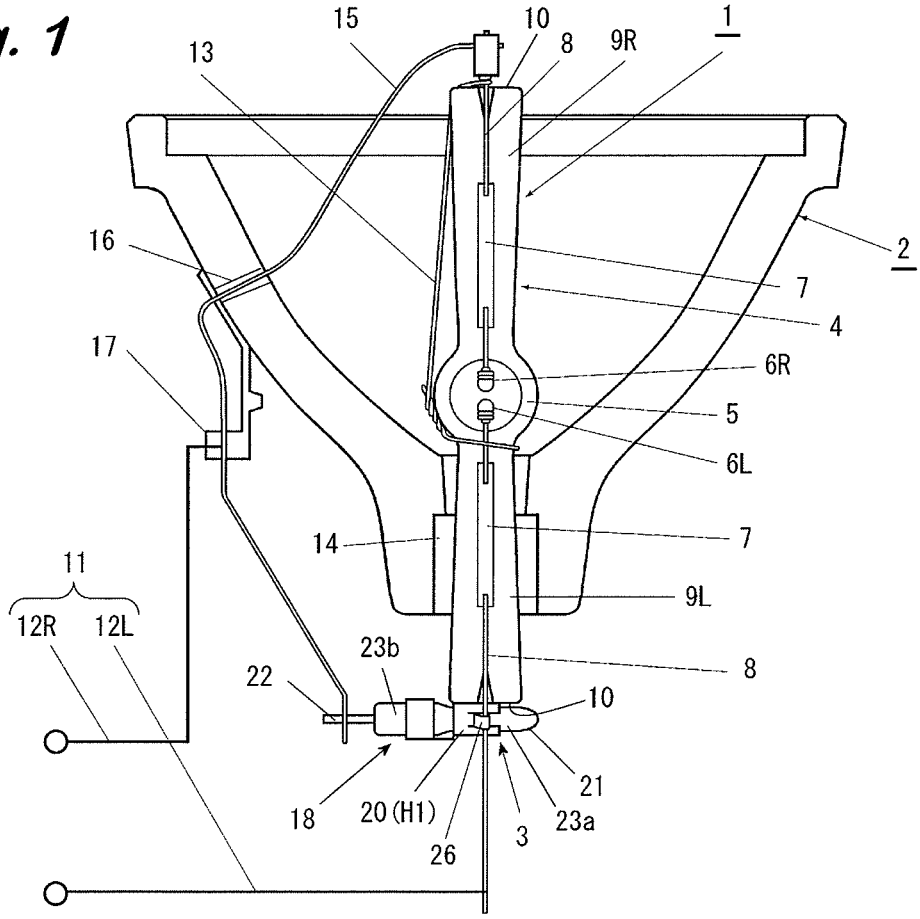
FIG. 1 is an entire view showing an example of a light source device according to the present invention.

A light source device shown in FIG. 1 comprises a high pressure discharge lamp 1, a concave reflector 2 reflecting a light emitted from the lamp 1, and a starting light source 3 for generating a UV-light that enhances the starting performance of the lamp. In the lamp 1, a pair of tungsten electrodes 6R, 6L are opposed at a short inter-electrode distance of about 1 mm, a starting gas such as mercury, halogen, for example, bromine and an argon gas are sealed in a discharge chamber 5 of an arc tube 4 comprising quartz glass, and a pair of electrode sealed portions 9R, 9L are formed in which electrodes 6R. 6L and metal foils 7 each comprising a molybdenum foil and electrode leads 8 each comprising a molybdenum wire connected therewith are formed by airtightly sealing from the discharge chamber 5 to both ends of the arc tube 4. Then, the electrode leads 8, 8 protruding from the end faces 10 of the respective electrode sealed portions 9R, 9L are connected to one polar side 12R and the other polar side 12L of a lighting circuit 11 for supplying an electric power to the lamp respectively. A metal wire 13 as a trigger line/antenna line for promoting arc discharge between the electrodes 6R and 6L is wired such that it is connected at one end to the electrode lead 8 protruding from the end face 10 of the electrode sealed portion 9R and wound in a loop shape at the other end around the outer periphery of the electrode sealed portion 9L.

In a concave reflector 2, a bottom hole 14 is formed at the bottom thereof for passing the electrode sealed portion 9L on one side of the high pressure discharge lamp 1 and fixing the same with cement or the like and a wiring hole 16 is formed at a reflection portion thereof for passing therethrough a lead wire 15 comprising a nickel wire connected to the electrode lead 8 protruding from the other electrode sealed portion 9R of the high pressure discharge lamp 1, and a wiring metal 17 is fixed at the back of the reflection portion for fixing the lead wire 15 led out of the wiring hole 16.

The starting light source 3 is connected in parallel with the lamp 1 to the lighting circuit 11 that applies a starting voltage between the electrodes 6R and 6L upon starting lighting of the high pressure discharge lamp 1, to generate the UV-light by application of the starting voltage between an internal electrode 19 and an external electrode 20 of the discharge tube 18.

Figure 2A:
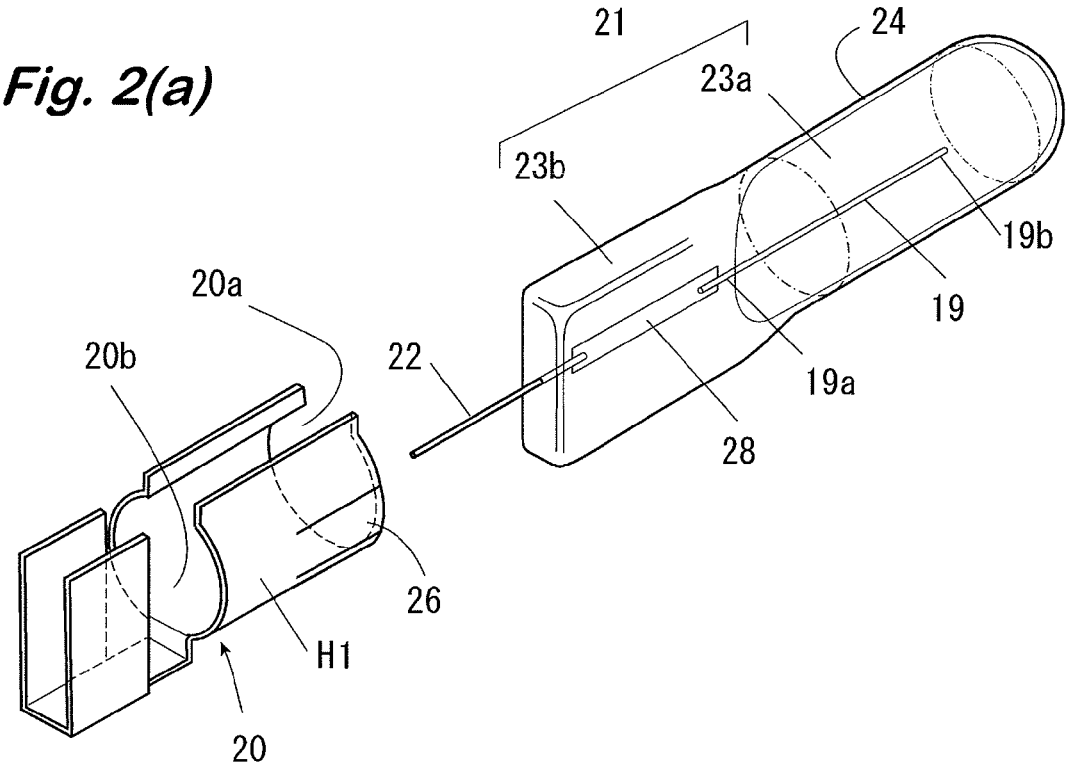
FIG. 2 is an explanatory view showing an example of a discharge tube as a starting light source.
Figure 2B:
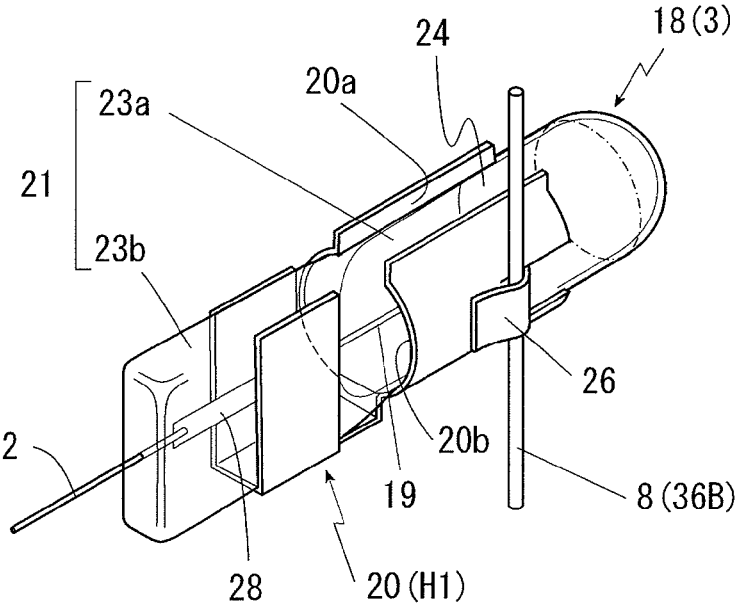

In the discharge tube 18, as shown in FIG. 2(*a*), a main body is formed of a glass seal tube 21 made of quartz glass in which a rare gas such as an argon gas is filled inside the glass seal tube 21 and the internal electrode 19 comprising a metal rod such as molybdenum welded at one end with a lead wire 22 is contained inside the glass seal tube 21. In the glass seal tube 21, one end of the light-emitting portion 23*a* sealed with a rare gas is sealed by chipping off and the other end thereof is pinch seal to form a pinch seal portion 23*b*. A metal foil 28, for example, a molybdenum foil welded at both ends to the internal electrode 19 and the lead wire 22 is encapsulated in the pinch seal portion 23*b*. That is, the base end 19*a* of the internal electrode 19 is encapsulated in the pinch seal portion 23*b* of the discharge tube 18 and the top end 19*b* thereof is extended from the pinch seal portion 23*b* so as to be exposed in the light-emitting portion 23*a*. Further, the internal electrode 19 is connected by way of the lead wire 22 protruding from the pinch seal portion 23*b* of the glass seal tube 21 to one polar side (on the side of the electrode 6R) 12R of the lighting circuit 11.

The external electrode 20 of the discharge tube 18 is disposed close to or in contact with both of the light-emitting portion 23*a* and the pinch seal portion 23*b*, and at least a portion disposed to the light-emitting portion 23*a* is formed as a holder H1 by bending a metal sheet into such a shape to grip and hold the discharge tube 18 while exposing a state of exposing a portion of the outer periphery 24 of the discharge tube 18.

That is, the holder H1 is fabricated by bending the metal sheet so as to cover the outer periphery 24 of the discharge tube 18 and formed to such a shape that the abutting top end portions are away from each other to form a slit 20*a* for exposing a portion of the outer periphery 24 of the discharge tube 18 facing the end face 10 of the electrode sealed portion 9L and so as to thoroughly cover the outer periphery 24 while leaving a portion exposed through the slit 20*a*.

Further, the inner surface of the portion covering the outer periphery of the discharge tube 18 is formed as a UV-light reflection surface 20*b* and can substantially increase the radiation amount of the UV-light by guiding the UV-light emitted from the discharge tube 18 as much as possible to the slit 20*a*.

Further, in the holder H1, a press fit tab terminal is formed by a portion of the metal sheet as a terminal 26 for fixing the external electrode 20 to a conductor part (electrode lead 8) applied with a voltage at a polarity opposite to that of the internal electrode 19 for electric connection.

In this embodiment, portions of the holder H1 disposed for the light-emitting portion 23*a* and the pinch seal portion 23*b* are formed by bending a metal sheet such as a spring stainless steel sheet (SUS304-CSP) of 0.2 mm thickness for gripping and holding the outer periphery of the light-emitting portion 23*a* and the pinch seal portion 23*b* respectively.

Then, as shown in FIG. 2(*b*), the terminal 26 of the holder H1 is bent so as to grip the electrode lead 8 and spot welded to the lead 8, so that the discharge tube 18 is firmly fixed to the electrode lead 8 comprising a rigid molybdenum wire and, at the same time, the external electrode 20 comprising the metal holder H1 is connected electrically to the other polar side (on the side of the electrode 6L) 12L of the light circuit 11.

Thus, since the UV-light emitted from the outer periphery 24 of the discharge tube 28 to the end face 10 of the electrode sealed portion 9L is directly entered to the end face 10 and, also the UV-light emitted from the outer periphery 24 of the discharge tube 18 to the inner surface of the holder H1 is reflected at the inner surface thereof and is incident to the end face 10 of the electrode sealed portion 9L, the starting performance of the lamp is improved remarkably.

Then, when the holder H1 is fixed to the electrode lead 8 with the slit 20*a* of the holder H1 being directed upward so as to oppose the end face 10 of the electrode sealed portion 9L of the high pressure discharge lamp 1 and the glass seal tube 21 is inserted therein, the discharge tube 18 having the external electrode 20 is mounted. Then, when the lead 22 of the internal electrode 19 of the discharge lead 18 is connected to one polar side (on the side of electrode 6R) 12R of the lighting circuit 11 by welding, etc., the operation for attaching the discharge tube 18 as the starting light source is completed.

In this case, since the holder H1 can be provisionally fixed to the electrode lead 8 by bending the tab terminal 26, it can be positioned easily and since the external electrode 20 is electrically connected by way of the tab terminal 26, troublesome wiring operation of the external electrode can also be simplified.

Then, when the high pressure discharge lamp 1 is started for lighting, a starting voltage is applied from the lighting circuit 11 to a portion between the internal electrode 19 and the external electrode 20 of the discharge tube 18 and discharge of exciting a rare gas is caused in the rare gas sealed in the glass seal tube 21 constituting the main body of the discharge tube 18 to generate the UV-light. The UV-light is emitted from the slit 20*a* of the holder H1 forming the external electrode 20, and incident to the end face 10 of the electrode sealed portion 9L of the lamp 1, transmits and propagate through the inside of the electrode sealed portion 9L and is radiated to the inside of the discharge chamber 5, so that the starting gas sealed in the discharge chamber 5 is excited, and tungsten forming the electrodes 6R, 6L releases initial electrons necessary for starting discharge to promote starting of the high pressure discharge lamp 1.

In this embodiment, since the external electrode 20 of the discharge tube 18 is disposed close to or in contact with both of the light-emitting portion 23*a* and the pinch seal portion 23*b*, and at least a portion disposed for the light-emitting portion 23*a* is formed as the holder H1 comprising a metal sheet which is bent into a shape of gripping and holding the outer periphery 24 thereof, the electrode area is outstandingly larger than the case where it is disposed only for the light-emitting portion or formed by winding coils and can generate a necessary and sufficient amount of the UV-light for enhancing the starting performance of the lamp. Further, since the slit 20*a* of the holder H1 opposes the end face 10 of the electrode sealed portion 9L and, in addition, the inner surface of a portion covering the outer periphery 24 of the discharge tube 18 is formed of an UV-light reflection surface 20*b*, the UV-light generated inside the discharge tube 18 can be emitted with no loss from the slit 20*a* and entered efficiently to the end face 10 of the electrode sealed portion 9L.

Further, when it is disposed at a position opposing the end face 10 of the electrode sealed portion 9L of the high pressure discharge lamp 1 in this embodiment, since it is not heated to a high temperature during lighting of the lamp, the discharge tube can stably cause discharge to generate the UV-light also in a hot state just after putting off the lamp.

Further, since the discharge tube 18 has a simple configuration, the manufacturing cost is not increased. Further, since the holder H1 holding the outer periphery 24 of the discharge tube 18 is fixed by welding to the electrode lead 8 of the lamp 1, there is no possibility of detaching from the electrode lead 8. Further, since the electrode lead 8 is formed of a rigid molybdenum wire, there is no possibility that the electrode lead 8 is unintentionally bent to cause a trouble that the outer periphery 24 of the discharge tube 18 held to the holder H1 does not oppose the end face 10 of the electrode sealed portion 9L.

Embodiment 2

Figure 3:
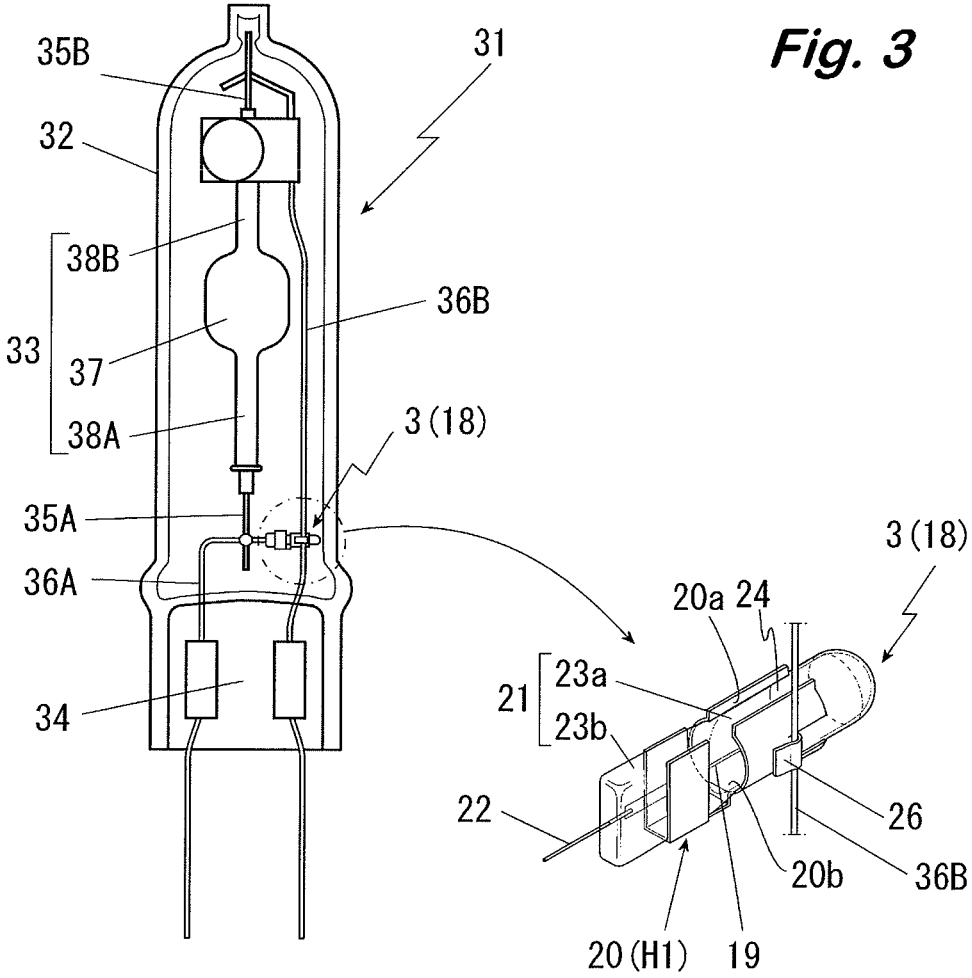
FIG. 3 is an explanatory view showing another example of the light source device.
Figure 4:
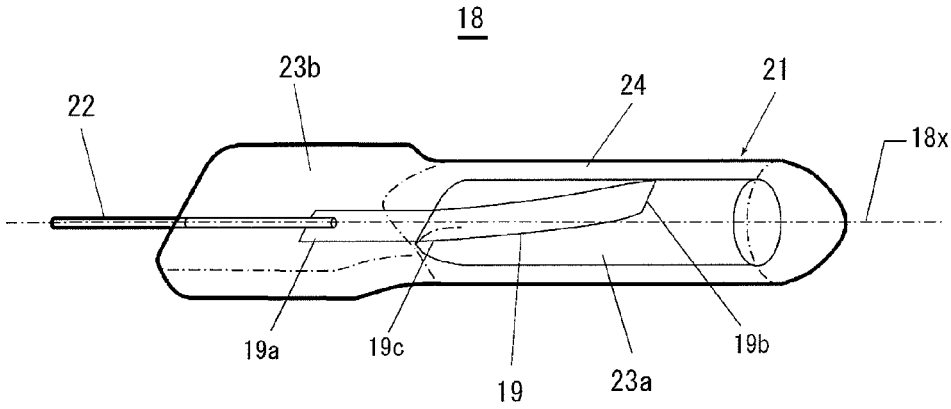
FIG. 4 is a perspective view showing another example of the discharge tube as the starting light source.

FIG. 3 shows an another embodiment. Portions identical with those in FIG. 2 carry the same reference numerals, for which detailed descriptions are omitted.

The light source device of this embodiment uses a ceramic metal halide lamp containing a heat resistant arc tube 33 made of ceramics in an airtight tube 32 made of glass as a high pressure discharge lamp 31, and a discharge tube 18 as a starting light source is disposed inside the airtight tube 32.

In the airtight tube 32, a pinch seal portion 34 is formed on one end by hot press sealing, and a pair of lead wires 36A, 36B connected to electrode leads 35A, 35B led out of both ends of the arc tube 33 are led out from the pinch seal portion 34 to the outside of the airtight tube 32.

In the ceramic arc tube 33, a pair of electrodes (not illustrated) are opposed and at least a light emitting material and a starting gas are sealed in a discharge chamber 37, and a pair of electrode sealed portions 38A, 38B are formed by sealing each of the electrodes by airtightly sealing a portion from the discharge chamber 37 to both ends of the arc tube 32, and the electrode leads 35A, 35B protruding from the end of the respective electrode sealed portions are connected by way of lead wires 36A, 36B to a lighting circuit not illustrated.

In the holder H1 as an external electrode 20 of the discharge tube 18, a tab terminal 26 is bent and press fitted, while directing the slit 20*a* to the arc tube 33, so as to grip a lead wire 36B that supplies power to the other electrode 35B of the arc tube 33 and fixed by spot welding.

Then, a lead wire 22 of an internal electrode 19 is welded to a lead wire 36A that supplies power to the electrode lead 35A of the arc tube 33.

Also in this embodiment, the holder H1 can be simply fixed by utilizing the tab terminal 26 to simplify the wiring operation to the external electrode 20 and, by welding the internal electrode 19 of the discharge tube 18 attached to the holder H1 to the lead wire 36A, discharge tube 18 as a starting light source can be attached simply.

Then, when the high pressure discharge lamp 31 is started for lighting, a starting voltage is applied by way of the lead wires 36A and 36B between the internal electrode 19 and the external electrode 20 of the discharge tube 18, so that the UV-light is generated in the discharge tube 18 and the UV-light is emitted from the slit 20*a* of the holder H1 and radiated to the arc tube 33 thereby exciting the starting gas sealed in the arc tube 33 and tungsten forming the electrode (not illustrated) releases initial electrons necessary for starting discharge to promote starting of the high pressure discharge lamp 31.

In this case, since the external electrode 20 of the discharge tube 18 is disposed close to or in contact with both of the light-emitting portion 23*a* and the pinch seal portion 23*b*, the electrode area is outstandingly large and a necessary and sufficient amount of the UV-light can be generated for enhancing the starting performance of the lamp. Further, since the slit 20*a* of the holder H1 opposes the end face 10 of the electrode sealed portion 9L and, in addition, the inner surface of a portion covering the outer periphery 24 of the discharge tube 18 is formed of a UV-light reflection surface, UV-light generated in the discharge tube 18 can be emitted with no loss from the slit 20*a* and can be entered efficiently to the end face 10 of the electrode sealed portion 9L.

For the embodiment described above, description has been made to a case of forming the external electrode 20 by bending a metal sheet such that portions disposed for the light-emitting portion 23*a* and the pinch seal portion 23*b* grip and hold the outer periphery of the light-emitting portion 23*a* and the pinch seal portion 23*b* respectively. However, it may suffice in the present invention that a portion disposed for the light-emitting portion 23*a* is formed by bending the metal sheet and a portion disposed for the pinch seal portion 23*b* may also be formed, for example, by winding coils connected at one end to the holder H1 around the pinch seal portion 23*b*.

Further, it is not restricted only to the case of forming the slit 20*a* to the holder H1 but a through hole may be formed.

Further, the internal electrode 19 of the discharge tube 18 is not restricted only to the rod shape but a metal foil 28 may be extended as it is in the light-emitting portion 23*a*.

Embodiment 3

FIGS. 4 to 7 show another embodiment of a starting light source 3 attached to the high pressure discharge lamp 1 shown in FIG. 1. Portions identical with those in FIG. 1 and FIG. 2 carry the same reference numerals, for which detailed explanations are to be omitted.

In a discharge tube 18 as a starting light source 3 of this embodiment, a main body thereof is formed of a glass seal tube 21 made of quartz glass, in which a rare gas such an argon gas is filled inside the glass seal portion 21, and an internal electrode 19 comprising a metal foil such as a molybdenum foil welded at one end with a lead wire 22 is contained. In the glass seal tube 21, one end of the light-emitting portion 23*a* filled with a rare gas is sealed by shipping off and the other end is pinch sealed to form a pinch seal portion 23*b* where a weld portion between the internal electrode 19 and the lead wire 22 is encapsulated. That is, the internal electrode 19 is encapsulated at the base end 19*a* welded with the lead wire 22 in the pinch seal portion 23*b* of the discharge tube 18, and extends along the central axis 18*x* of the glass seal tube 21 as far as the top end 19*b* so as to be exposed in the light-emitting portion 23*a* from the pinch seal portion 23*b*. Thus, a portion from a base exposure end 19*c* to a top end 19*b* is exposed in the light-emitting portion 21*a*. Further, the internal electrode 19 is connected by way of the lead wire 22 protruding from the pinch seal portion 23*b* of the glass seal tube 21 to one polar side (on the side electrode 6R) 12R of the lighting circuit 11 (refer to FIG. 1).

The external electrode 20 of the discharge tube 18 is formed of a metal holder H2 that hold the outer periphery 24 of the discharge tube 18 so as to oppose the end face 10 of the electrode sealed portion 9L in the lamp 1 inserted through the bottom hole 14 of the reflector 2 and fixed to the electrode lead 8 protruding from the end face 10. The holder H2 comprises a holder main body 25 formed of a metal sheet such as a spring stainless steel sheet (SUS304-CSP) of 0.2 mm thickness bent into such a shape to grip and hold the outer periphery 24 of the discharge tube 18, and a terminal 26 for fixing the main body to an electrode lead 8 protruding from the end face 10 of the electrode sealed portion 9L for electric connection.

The metal sheet forming main body 25 of the holder H2 is bent into such a shape to grip and hold the outer periphery 24 of the discharge tube 18 so as to cover the same at a position opposing the end face 10 of the electrode sealed portion 9L. A window hole 27 for exposing the outer periphery 24 opposing the end face 10 of the electrode sealed portion 9L is formed in the metal sheet.

Figure 5A:
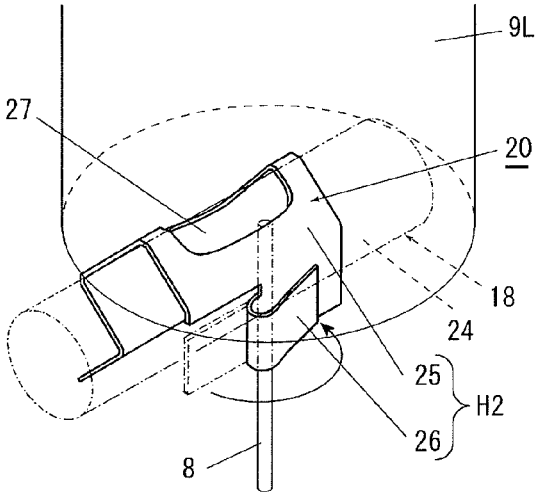
FIG. 5 is a view showing an example of a holder that constitutes an external electrode of the discharge tube as the starting light source.
Figure 5B:
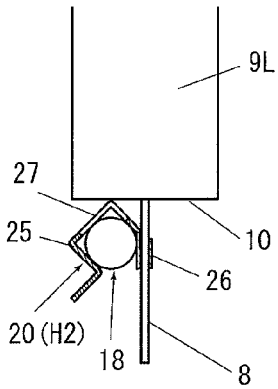

Further, a tab terminal as a fixing terminal 26 is formed by a portion of the metal sheet, and the tab terminal is bent from the state shown by a dotted chain to the state shown by a solid line in FIG. 5(*a*) so as to grip the electrode lead 8 and is spot welded to the electrode lead 8 by which the discharge tube 18 is firmly fixed to the electrode lead 8 comprising a rigid molybdenum wire and, at the same time, the external electrode 20 comprising the metal holder H2 is electrically connected to the other polar side (on the side of the electrode 6L) 12L of the lighting circuit 11.

The discharge tube 18 is attached to the external electrode 20 comprising the holder H2.

In the discharge tube 18, one or both of the base exposure end 19*c* and the top end 19*b* of the internal electrode 19 are disposed at a position opposing the end face 10 of the electrode sealed portion 9L on one side of the high pressure discharge lamp 1 inserted through the bottom hole 14 in the concave reflector 2.

Figure 6A:
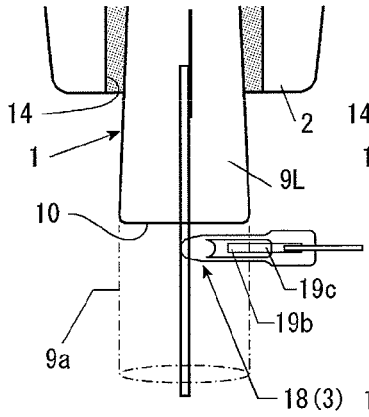
FIG. 6 is a view showing the position for attaching the discharge tube as the starting light source.
Figure 6B:
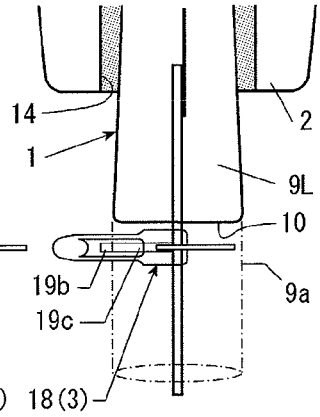
Figure 6C:
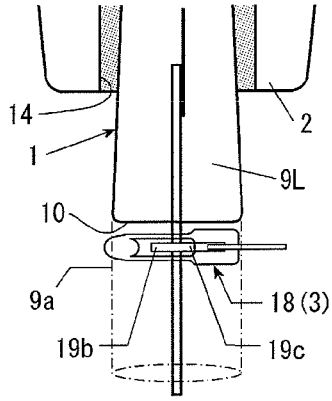

In this case, it is most preferred that the discharge tube is disposed such that the top end 19*b* of the internal electrode 19 is positioned in an imaginal cylinder 9*a* on the extension of the outer periphery of the seal portion 9L of the high pressure discharge lamp 1 as shown in FIG. 6(*a*), or the base exposure end 19*c* of the internal electrode 19 is disposed so as to position in the imaginal cylinder 9*a* as shown in FIG. 6(*b*), further, both the top end 19*b* and the base exposure end 19*c* of the internal electrode 19 are disposed so as to position in the imaginal cylinder 9*a* in a case where the length from the former to the latter is smaller than the diameter of the imaginal cylinder 9*a* as shown in FIG. 6(*c*).

Figure 7:
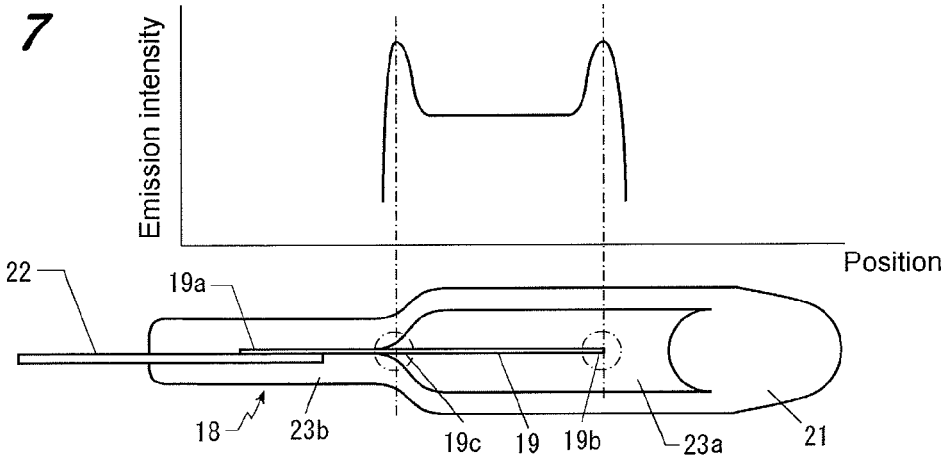
FIG. 7 is a graph showing a distribution of a UV-light emission intensity of the starting light source.

FIG. 7 is an explanatory view showing an emission intensity distribution of a UV-light in which axis X represents the longitudinal position of the electrode and axis Y represents the UV-light emission intensity. According to the graph, it can be seen that the emission intensity is higher at the top end 19*b* and the base exposure end 19*c* of the internal electrode 19.

It is estimated that when a starting voltage is applied, the internal electrode 19 and the inner surface of the light-emitting portion 23*a* are polarized into positive and negative poles, in which discharge tends to occur at the top end 19*b* since lines of electric force concentrate thereto and discharge tends to occur in the vicinity of the base exposure end 19*c* since the gap between the internal electrode 19 and the inner surface of the light-emitting portion 23*a* is small due to the pinch seal of the glass seal tube 21.

Then, upon starting lighting of the high pressure discharge lamp 1 and, when a starting voltage is applied from the lighting circuit 11 to a portion between the internal electrode 19 and the external electrode 20 of the discharge tube 18, discharge that excites a rare gas is caused in the rare gas filled in the glass seal tube 21 of the discharge tube 18 to generate the UV-light, the UV-light is emitted through the window hole 27 formed in the main body 25 of the holder H2 forming the external electrode 20 and incident to the end face 10 of the electrode sealed portion 9L of the lamp 1, transmits and propagates through inside of the electrode sealed portion 9L and is radiated into the discharge chamber 5 thereby exciting the starting gas sealed in the discharge chamber 5 and, at the same time, tungsten forming the electrodes 6R, 6L releases initial electrons necessary for starting the discharge to promote starting of the high pressure discharge lamp 1.

In this case, in the discharge tube 18 as the starting light source 3, since one or both of the top end 19*b* and the base exposure end 19*c* of the internal electrode 19 is disposed at a position opposing the end face 10 of the electrode sealed portion 9L of the high pressure discharge lamp 1, the UV-light outputted from a portion of high emission intensity distribution can be entered to the end face 10.

Figure 8A:
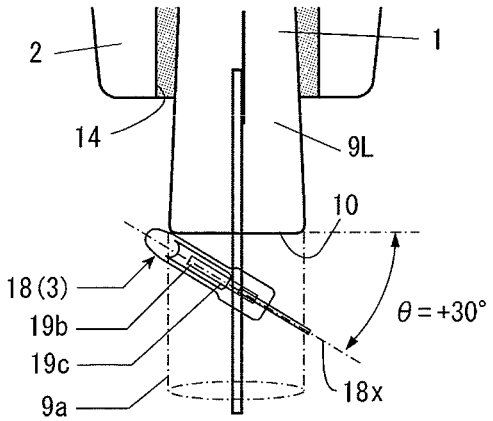
FIG. 8 is a view showing another state of attaching the starting light source.
Figure 8B:
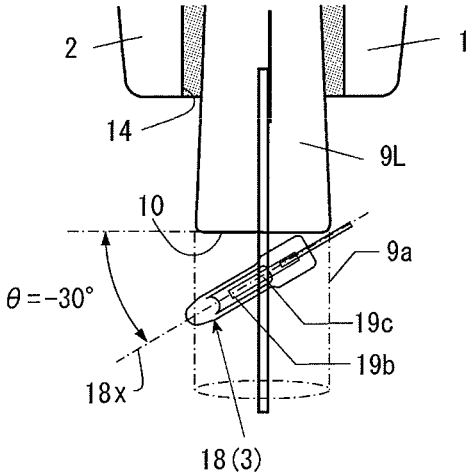

Further, the discharge tube 18 is disposed not restricted only to a case where the central axis 18X extending in the longitudinal direction is in parallel with the end face 10 of the electrode sealed portion 9L of the lamp, as described above but it may be inclined as shown in FIG. 8.

However, in a case where the angle of inclination $\theta > +30°$ and $\theta < -30°$, since the UV-light emitted from the top end 19*b* or the base exposure end 19*c* of the internal electrode 19 toward the end face 10 of the electrode sealed portion 9L of the lamp 1, the UV-light is refracted when it transmits the grass saal tube 21 at the inner surface and the outer surface of the light-emitting portion 23*a*, the radiation amount of the UV-light to the end face 10 is decreased. As a result, since the amount of the UV-light reaching the inside of the arc chamber 5 is decreased, not only the efficiency is lowered but also the central axis 18X and the electrode lead 8 of the lamp 1 approaches as the θ is larger, it results in a problem of increasing the possibility of causing discharge and short circuit between them.

Accordingly, it is desirable that the angle of inclination θ of the central axis 18X to the end face 10 is arranged as:

$$-30° \leq \theta \leq +30°$$

Furthermore, the internal electrode 19 is not necessarily formed of a molybdenum foil but may be formed in a rod shape as in the Embodiments 1 and 2.

Embodiment 4

Figure 9A:
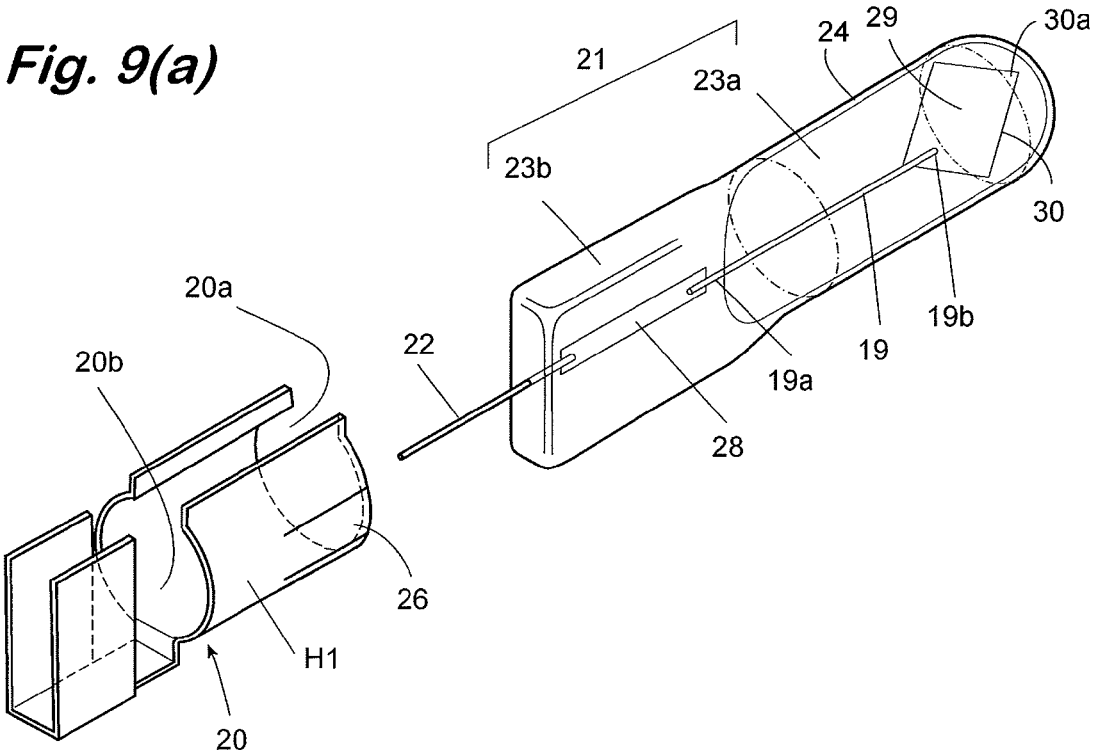
FIG. 9 is an explanatory view showing a further example of the discharge tube as the starting light source.
Figure 9B:
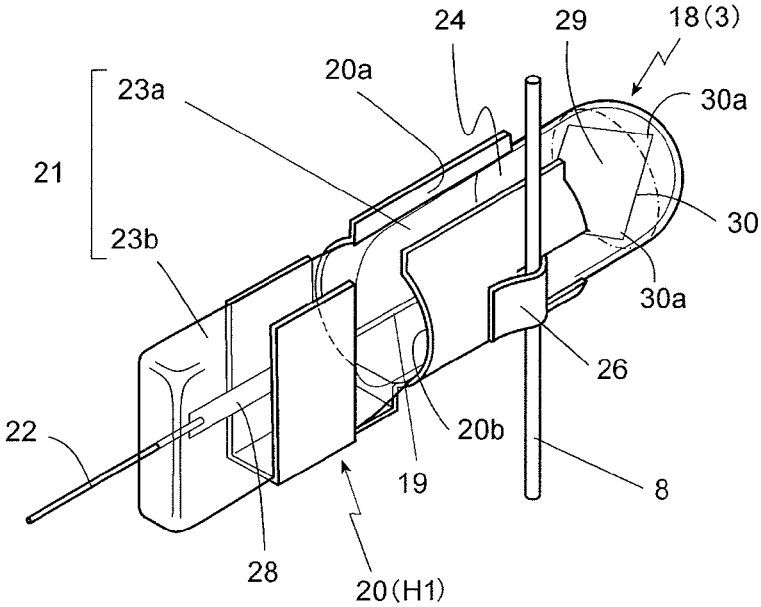

FIG. 9 shows a still further embodiment of a starting light source 3 attached to the high pressure discharge lamp 1 shown in FIG. 1. Portions identical with those in FIG. 1 and FIG. 2 carry the same reference numerals for which detailed descriptions are to be omitted.

A discharge tube 18 as a starting light source 3 of this embodiment has the same configuration as that in Embodiment 1 (FIG. 2) as shown in FIGS. 9(*a*) and (*b*) excepting that at least one metal piece 29 for forming a charge concentration portion is contained in the glass seal tube 21.

Figures 10A, 10B, 10C, 10D, 10E, 10F:
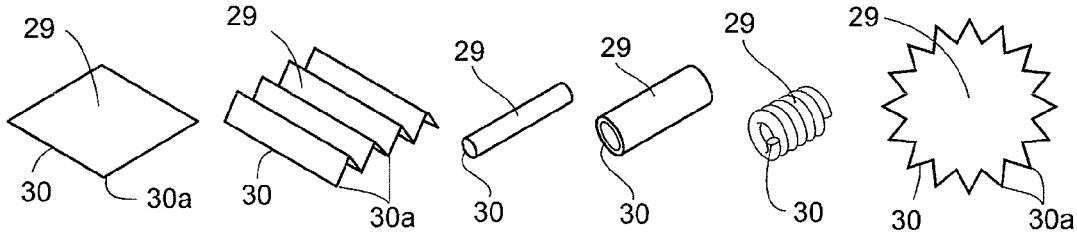
FIG. 10 is a view showing an example of a metal piece forming a charge concentration portion.

The metal piece 29 for forming the charge concentration portion is formed of a heat resistant metal, for example, molybdenum, nickel, or tungsten and the shape is optional so long as the piece is contained in the light-emitting portion 23*a*. For example, it is not restricted to a square plate body as shown in FIG. 10(*a*) but rectangular plate body flexed in a corrugated shape as shown in FIG. 10(*b*), a rod-shape as shown in FIG. 10(*c*), a tubular shape as shown in FIG. 10(*d*), a coiled shape as shown in FIG. 10(*e*) or a shape punched into a star-form as shown in FIG. 10(*f*) can be used optionally.

Since an edge portion 30 to which charges are concentrated is formed in any of the metal pieces 29 for forming the charge concentration portion, insulation breakdown tends to occur and more insulation breakdown tends to occur in a case where an angled corner 30*a* is formed to the edge portion 30.

Then, when the holder H1 is fixed to the electrode lead 8 while opposing the slit 20*a* of the holder H1 to the end face 10 of the electrode sealed portion 9L of the high pressure discharge lamp 1, and the glass seal tube 21 is inserted therein, the discharge tube 18 having the external electrode 20 is attached. Then, when the lead wire 22 of an internal electrode 19 of the discharge tube 18 is connected on one polar side (on the side electrode 6R) 12R of the lighting circuit 11 by welding or the like, the operation of attaching the discharge tube 18 as the starting light source is completed.

In this step, since the holder H1 can be provisionally fixed to the electrode lead 8 by bending the tab terminal 26, the positioning is facilitated. Further, since it is connected electrically by way of the tab terminal 26, troublesome wiring operation for the external electrode 20 can also be simplified.

Then, when the high pressure discharge lamp 1 is started for lighting, a starting voltage is applied from the lighting circuit 11 to a portion between the internal electrode 19 and the external electrode 20 of the discharge tube 18, the internal electrode 19 and the external electrode 20 are charged in opposite polarity to form an electric field between both of them and, when the electric breakdown occurs between the internal electrode and the external electrode, a UV-light is radiated.

Figure 11A:
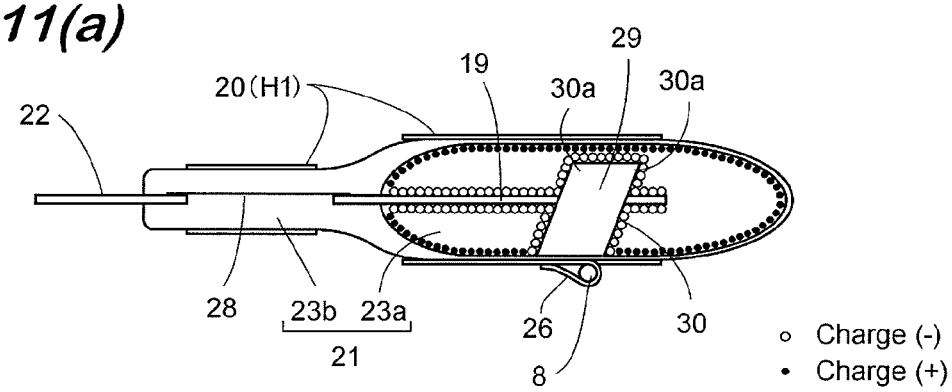
FIG. 11 is a schematic view showing an ionized state in the discharge tube.
Figure 11B:
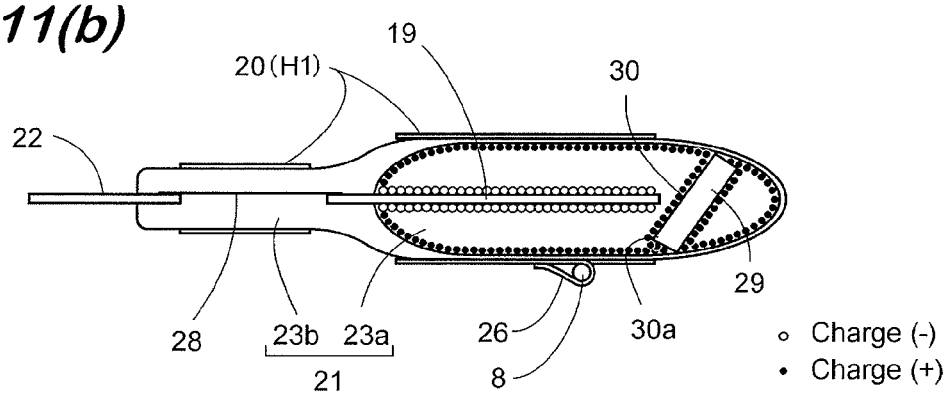

In this embodiment, since the metal piece 29 for foaming the charge concentration portion is sealed in the light-emitting portion 23*a*, when the internal electrode 19 and the external electrode 20 are charged to negative polarity and positive polarity for instance, the metal piece 29 is charged negatively if it is in contact with the internal electrode 19 as shown in FIG. 11(*a*).

In this case, since charges are concentrated to the edge portion and, particularly, to the angled corner 30*a* of the edge portion 30 of the metal piece 29 and the distance from the edge portion 30 (30*a*) to the external electrode 20 is shortened, dielectric breakdown tends to occur at the edge portion 30 (30*a*) and discharge is started at a low voltage.

Further, as shown in FIG. 11(*b*), discharge is started at a low voltage also in a case where the metal piece 29 is not in contact with the internal electrode 19 but is in contact with the inner periphery of the light-emitting portion 23*a*.

That is, since the light-emitting portion 23*a* is polarized due to the dielectric field formed between the internal electrode 19 and the external electrode 20 and the inner periphery is charged positively opposite to the polarity of the internal electrode 19, the metal piece 29 in contact with the inner periphery is also charged to a polarity opposite to the polarity of the internal electrode 19, electric charges are concentrated to the edge portion 30 (30*a*) and since the edge portion approaches the internal electrode, dielectric breakdown tends to occur at the edge portion and discharge is started at a low voltage.

As described above, even when the metal piece 29 is not in contact with the internal electrode 19, electric charges are concentrated in any case to the edge portion 30 (30*a*) of the metal piece 29 and, in addition, since the edge portion approaches the internal electrode 19, discharge tends to occur from the edge portion 30 (30*a*) and, accordingly, discharge is started at a low voltage.

Thus, the UV-light is generated from the discharge tube 18, and the UV-light is emitted from the slit 20*a* of the holder H1 forming the external electrode 20 and entered to the end face 10 of the electrode sealed portion 9L of the lamp 1, transmits and propagates through the inside of the electrode sealed portion 9L and radiated into the discharge chamber 5, whereby the starting gas sealed in the discharge chamber 5 is excited, and tungsten forming the electrodes 6R, 6L releases initial electrons necessary for starting discharge to promote starting of the high pressure discharge lamp 1.

Figure 12:
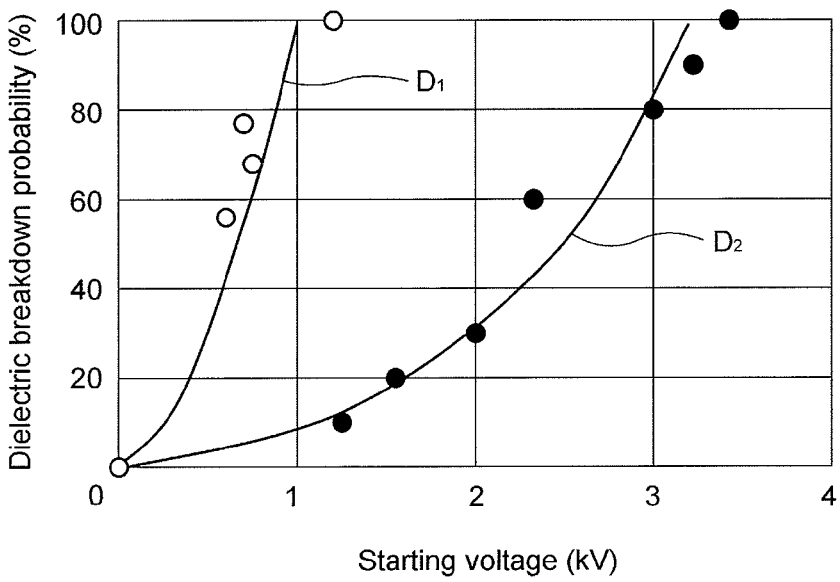
FIG. 12 is a graph showing a relation between a starting voltage and a dielectric breakdown ratio of a discharge tube.
Figure 13:
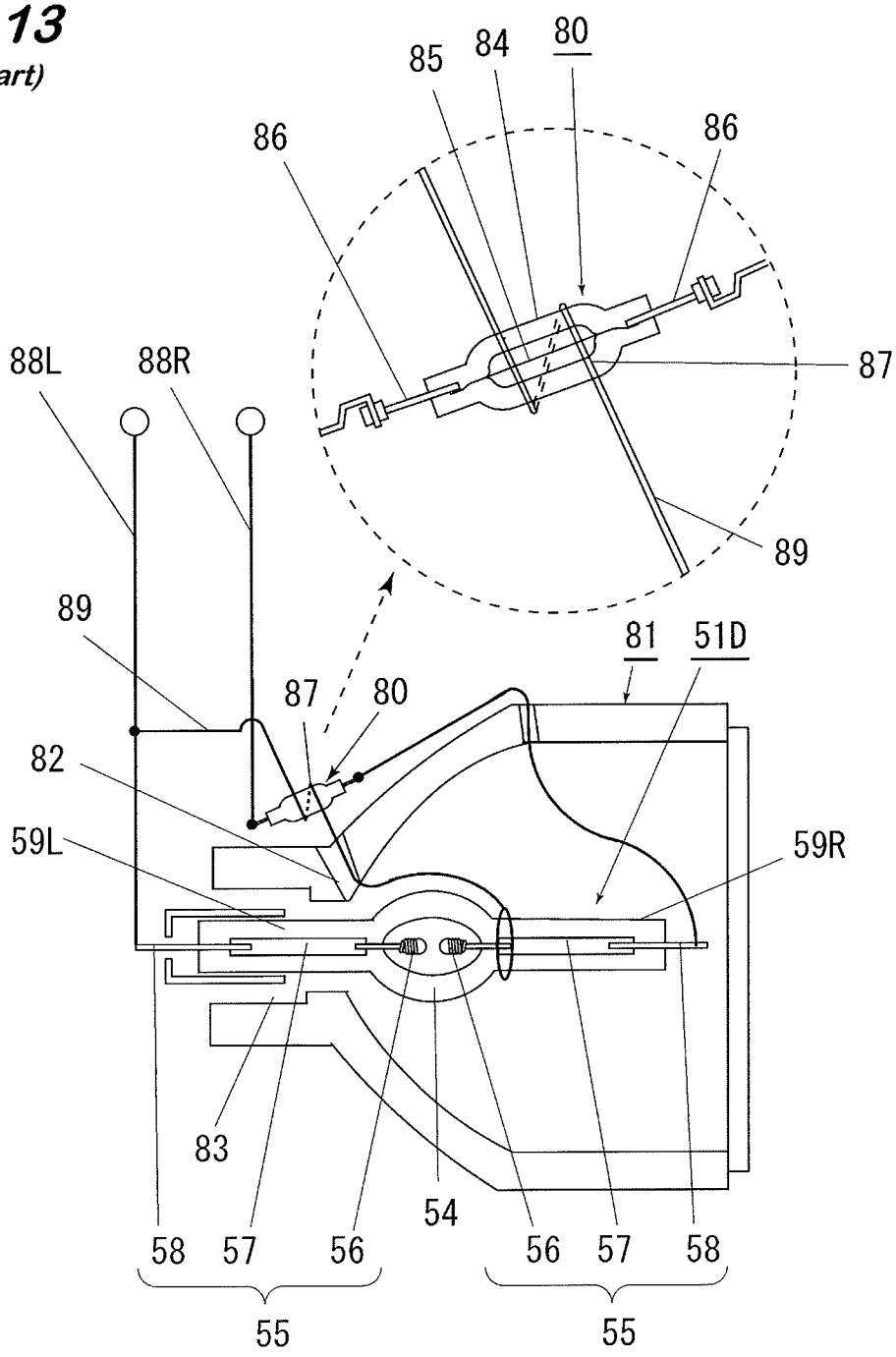
Fig. 13 (prior art)
FIG. 13 is a view showing an existent technique for enhancing the starting performance of a high pressure charge lamp.

FIG. 12 is a graph showing a relation between a starting voltage and dielectric breakdown ratio of a discharge tube, which shows experimental data $D_1$ for a discharge tube 18 where a metal piece 29 for forming charge concentration portion is sealed and experimental data $D_2$ of a discharge tube under identical conditions different only in that the metal piece 29 for forming charge centralized portion is not sealed shown in FIG. 10(*a*) in comparison.

According to the graph, the breakdown dielectric probability is as low as about 10% for a discharge tube not sealed with a metal piece 29 at a starting voltage of 1 kV and dielectric breakdown scarcely occurs, whereas the dielectric breakdown probability was 100% for the discharge tube 18 sealed with the metal piece 29 and dielectric breakdown was observed for all of the cases.

That is, even when the starting voltage is lowered to 1 kV, since the discharge tube 18 undergoes dielectric breakdown to reliably generate the UV-light, starting of the high pressure discharge lamp is promoted.

The starting light source of this embodiment is not restricted only to a case where it is disposed at the end face 10 of the sealed portion 9L on one side of the double-end type high pressure discharge lamp 1 but it can be used being disposed in the airtight tube 32 of the ceramic metal halide lamp 31 in the same manner as an Embodiment 2 (FIG. 3).

INDUSTRIAL APPLICABILITY

The present invention contributes to the improvement of the starting performance of a high pressure discharge lamp used for a light source device such as for liquid crystal projectors, DLP projectors or illumination apparatus.

DESCRIPTION FOR REFERENCES

1 high pressure discharge lamp
3 starting light source
18 discharge tube
19 internal electrode
20 external electrode
20*a* slit
20*b* UV-light reflection surface

23*a* light-emitting portion
23*d* pinch seal
24 outer periphery
H holder
26 terminal

The invention claimed is:

1. A light source device including:

a high pressure discharge lamp having a pair of electrodes opposed to each other and at least a light-emitting material and a starting gas filled in a discharge chamber of an arc tube, and a pair of electrode sealed portions for encapsulating each of the electrodes by airtightly sealing a portion from the discharge chamber to both ends of the arc tube, and connected by way of electrode leads protruding from end faces of respective electrode sealed portions to a lighting circuit, and a starting light source that radiates a UV-light to the discharge chamber for enhancing the starting performance of the lamp upon starting lighting, wherein the starting light source comprises a discharge tube that generates the UV-light by application of a starting voltage between the electrodes upon starting lighting of the lamp, the discharge tube comprises an internal electrode extending from a pinch seal portion formed on one end thereof to a light-emitting portion, and an external electrode in contact with both of the light-emitting portion and the pinch seal portion, in which the external electrode is formed as a holder of the discharge tube by bending fabrication of a metal sheet into a shape of covering the outer periphery thereof, the holder has one portion of gripping and holding the light-emitting portion, and another portion of gripping and holding the pinch seal portion, and mating top ends thereof are spaced apart to form a slit through which a part of the outer periphery along the longitudinal direction of the internal electrode is exposed, and the holder has a terminal for electric connection fixed to a conductive part applied with a voltage at a polarity opposite to that of the internal electrode.

2. A light source device according to claim 1, wherein the high pressure discharge lamp is a metal-halide lamp comprising a heat resistant arc tube contained in an airtight outer bulb, in which the starting light source is located in the outer bulb, the internal electrode is connected to one of the electrode leads protruding from respective end faces of the arc tube, and the external electrode is fixed to another electrode lead by way of the terminal of the holder.

3. A light source device according to claim 1, wherein one of the electrode sealed portions of the high pressure discharge lamp is attached to a concave reflector by being inserted through a bottom hole formed in the bottom, the discharge tube of the starting light source is held such that the exposed outer periphery is opposed to the end face of one of the electrode sealed portions by the holder, and the external electrode is fixed to the electrode lead protruded from the end surface by way of the terminal.

4. A light source device according to claim 1, wherein the external electrode is formed by bending a metal sheet such that respective portions disposed to the light-emitting portion and the pinch seal portion grip and hold the outer periphery of the light-emitting portion and the pinch seal portion.

5. A light source device according to claim 1, wherein a portion of the inner surface of the holder covering the outer periphery of the discharge tube is formed as a UV-light surface.

6. A light source device according to claim 1, wherein one of the electrode sealed portions of the high pressure discharge lamp is attached to a concave reflector by being inserted through a bottom hole formed in the bottom of the reflector, one or both of a base exposure end and a top end of the internal electrode exposed in the light-emitting portion of the discharge tube constituting the starting light source are disposed at a position facing the end face of the electrode sealed portion of the high pressure discharge lamp inserted through the bottom hole of the concave reflector.

7. A light source device according to claim 6, wherein an angle of inclination θ of the center axis of the internal electrode to the end face of the electrode sealed portion of the high pressure discharge lamp satisfies the relation:

$$-30° \leq \theta \leq +30°.$$

8. A light source device according to claim 1, wherein at least one metal piece forming a charge concentration portion is encapsulated, in addition to the internal electrode, into the light-emitting portion of the discharge tube as the starting light source.

* * * * *